US005456203A

United States Patent [19]

Oglesby, Jr. et al.

[11] Patent Number: 5,456,203

[45] Date of Patent: Oct. 10, 1995

[54] APPARATUS FOR MOUNTING A STONE GOLF COURSE MARKER

[75] Inventors: George T. Oglesby, Jr., Elberton; Edwin R. Sherrill, Jr., Atlanta, both of Ga.

[73] Assignee: Fairway Stone, Ltd., Tucker, Ga.

[21] Appl. No.: 24,198

[22] Filed: Feb. 26, 1993

[51] Int. Cl.[6] ..... E04H 13/00; G09F 19/00

[52] U.S. Cl. ..... 116/209; 116/63 R; 40/124.5; 52/103

[58] Field of Search ..... 116/209, 63 R; 273/176 A; 52/295, 587, 263, 103; 40/606, 124.5; 248/679

[56] References Cited

U.S. PATENT DOCUMENTS

| | | | |
|---|---|---|---|
| 1,500,870 | 7/1924 | Holdredge | 40/124.5 X |
| 1,661,242 | 3/1928 | Truxal | 116/63 R |
| 3,477,181 | 11/1969 | Robison | 52/103 |
| 3,758,999 | 9/1973 | Matrey | 52/103 |
| 3,916,821 | 11/1975 | Pies | 52/103 |
| 4,054,000 | 10/1977 | Lisle | 40/124.5 |
| 4,185,425 | 1/1980 | Merkel | 52/103 |
| 4,408,940 | 10/1983 | Fischer | 248/679 X |
| 4,736,554 | 4/1988 | Tyler | 52/295 X |
| 5,014,472 | 5/1991 | Svensson | 52/103 |

FOREIGN PATENT DOCUMENTS

| | | | |
|---|---|---|---|
| 2142949 | 1/1985 | United Kingdom | 52/103 |

*Primary Examiner*—William A. Cuchlinski, Jr.
*Assistant Examiner*—Willie Morris Worth
*Attorney, Agent, or Firm*—Jones & Askew

[57] ABSTRACT

An arrangement for mounting a stone golf course marker to a foundation and for mounting accessory equipment to a stone golf course marker is disclosed. A connector is embedded in a concrete foundation and comprises a pair of parallel spaced-apart rods interconnected by a cross member. The rods are maintained in predetermined spaced-apart relation by the connector, enabling corresponding holes to be drilled in the base of the stone golf course marker at the manufacturing facility. The mounting arrangement for mounting accessory equipment to a stone golf course marker includes the use of sleeves disposed within bores in the stone golf course marker, with mounting members of the accessory equipment engaging the sleeves, rather than engaging the stone golf course marker directly. This sleeve arrangement disperses stresses and helps minimize cracking, chipping and damage to the stone marker resulting from lateral stresses exerted on the accessory equipment.

5 Claims, 2 Drawing Sheets

APPARATUS FOR MOUNTING A STONE GOLF COURSE MARKER

TECHNICAL FIELD

The present invention relates generally to stone markers of the type used for golf course signage. More specifically, the present invention relates to an apparatus for mounting such a stone marker to a base and to an apparatus for mounting accessory equipment to the marker.

BACKGROUND OF THE INVENTION

Stone markers are extremely popular for use as golf course and country club signage. These markers are made from many different types of stone, including, but not limited to, marble, limestone, slate and granite. These markers are more desirable than markers made of substances such as wood or plastic because the latter substances are less durable and are often not as aesthetically pleasing.

Of the many different types of stone used, granite is the most desirable material because of its extreme hardness. A typical granite marker is one to five feet in height, eight to fifteen inches in width, and two to twenty-four inches in depth. Granite's composition and characteristics give these markers longevity of life and imperviousness to normal wear, even after long periods of exposure to harsh weather conditions. These markers can be sandblasted, chiseled or otherwise carved to show the pictorial layout of a particular golf hole with corresponding yardage and other additional information. Other accessory equipment such as golf ball washers, trash cans, cleaning devices for golf spikes, and towel holders are also frequently attached to the markers.

One problem associated with a typical granite marker is the difficulty in mounting the marker so that it does not move or fall when force is applied to the marker. Wind hitting the face of a granite marker, if strong enough, can often cause the marker to tip, fall and fragment. Wild game often is attracted to such a stone marker for various reasons. For example, elk and moose in the western and northwestern United States have a tendency to use such a stone marker as a post for rubbing their antlers during rutting season. Further, golfers not utilizing due care often hit such a marker with motorized golf carts. Once such a granite marker falls or is displaced, there is usually both great difficulty associated in lifting or repositioning such a piece of stone, typically weighing several hundred pounds, and great cost in repairing or replacing it.

To prevent a marker from being displaced during such an application of force, a marker often is embedded partially in the ground. A hole of appropriate depth is dug, a bottom portion of the marker is placed in the hole, and the hole is then filled again with dirt. Alternatively, a footer is dug, the marker is placed in the footer, and the footer is filled with concrete to permanently affix the marker in that particular location. The buried part of the marker or the portion of the of the marker's base lying in the cured concrete effectively serves as the anchor of the marker.

However, problems are associated with these methods of securing the granite marker. Gradual settling of the ground often causes a marker secured in this manner to lean in an unsightly manner or to fall over completely. Also, granite is very porous. If the marker is buried directly in the ground, moisture from the ground gradually seeps into the granite and, after prolonged exposure to freezing and thawing temperatures, the granite may crack, weaken, and become damaged. Further, after the absorbed water evaporates or otherwise seeps from the granite, minerals from the soil often are left in the granite, causing unsightly discoloration of the stone.

In order to avoid these problems, a foundation is often used to insulate the marker from the ground and thus to prevent much of the moisture damage caused to the marker. In addition to insulating the granite from the adverse effects of ground water, the foundation also provides a support surface more resistant to settling.

Alternatives involving a marker mounted on a foundation use fastening mechanisms that include rods. These rods are partially embedded in the foundation and extend vertically to fit into holes that are drilled or otherwise formed on the underside of the granite marker. The rods aid in supporting the marker during occasions in which a tipping force is applied to the marker, such as during incidents of vandalism, that would normally cause the marker to tip over, to move or to otherwise be damaged.

Two options exist for aligning the rods with the holes. Under a first approach, a pair of rods is first embedded in the foundation. The distance between the two embedded rods is then measured, and the holes in the base of the marker are then formed, with the distance between the holes corresponding to the measured distance between the rods in the particular foundation. In a second method, the holes in the base of the foundation are pre-cut at the manufacturing plant when the marker is fabricated. When the rods are subsequently embedded in the foundation, the worker laying the foundation must ensure that the distance between the rods corresponds to the distance between the holes in the base of the foundation.

Drawbacks exist, however, to these support mechanisms. A mounting arrangement that provides a single rod embedded in a concrete foundation provides only limited support against a tipping force. In mounting arrangements which employ multiple rods, it is difficult to install the support mechanism such that the rods accurately align with the holes in the base of the marker. If the holes are pre-drilled in the base of the marker at the manufacturing facility, then any variation in the spacing of the rods when the worker embeds the rods in the foundation will cause misalignment. The fact that often the foundation is poured and the rods are placed by relatively unskilled labor further complicates any hopes of the rods being positioned in the desired spaced-apart relation. On the other hand, if the rods are first embedded in the foundation and the holes are then drilled in the base of the marker to match the spacing of the rods, the drilling process can be both labor and cost intensive when performed in the field because of the special diamond-tipped drill bit required by the hardness of the granite.

Thus, there is a need for a mounting relationship permitting holes to be pre-drilled at the time of fabrication with the assurance that the rods embedded in the foundation will correspondingly align with the pre-drilled holes.

In addition to the problems associated with the initial erection of the stone markers, the mounting relationship may become compromised over a period of time. The rods may loosen from the foundation for one of many reasons, including thermal cycling, cracking of the concrete along the stress lines associated with the rods, and elements exerting force on the marker and causing stress to, and cracking of, the foundation. The rods may loosen, wobble and become so unsecured that they could be completely removed from the foundation.

Thus, there is a need to provide a mounting arrangement for stone markers which will securely anchor rods in the foundation and which will help disperse stress applied to the foundation so as to resist loosening over time.

These granite markers, as mentioned previously, may also hold accessory equipment used by golfers on the golf course. This equipment is often mounted to an edge of the marker. Holes are drilled into the edge of the marker, and horizontally-projecting mounting members associated with the accessory equipment are inserted into the holes. The mounting members are then secured in place in the holes with an adhesive such as an epoxy or caulk.

This mounting arrangement, however, has its drawbacks. If any of the attached equipment becomes damaged or worn out, it is a difficult and time-consuming process to detach the equipment because of the adhesive. Furthermore, lateral forces will be exerted on mounting members, resulting from various sources such as the weight of the accessory equipment, the wind load against the accessory equipment, a golfer leaning against the equipment, or the vigorous jostling of the equipment resulting from agitating a ball in the ball washer. In response to these lateral forces, a mounting member will transmit force to the walls of a bore in the marker primarily in two locations, the rim and the base of the bore. This point contact between the mounting member and the stone can cause the stone to chip, crack, abrade or otherwise be damaged.

Thus, there is a need to provide an arrangement for mounting accessory equipment to a stone marker which does not require an adhesive or caulk to secure the accessory equipment to the stone marker.

There is a further need to provide an arrangement for mounting accessory equipment to a stone marker which protects the marker against wear, abrasion, or other damage resulting from loads applied to the accessories.

SUMMARY OF THE INVENTION

As will be seen, the present invention overcomes these and other problems associated with the prior art. Stated generally, the stone golf course marker of the present invention provides a mounting arrangement which permits holes to be pre-drilled at the time of fabrication with the assurance that the rods embedded in the foundation will correspondingly align with the pre-drilled holes. The stone golf course marker also provides a mounting arrangement for stone markers which will securely anchor rods in the foundation and which will help disperse stress applied to the foundation so as to resist loosening over time. Further, the stone golf course marker of the present invention provides an arrangement for mounting accessory equipment to a stone marker which does not require an adhesive or caulk to secure the accessory equipment to the stone marker. The stone golf course marker also provides an arrangement for mounting accessory equipment to a stone marker which protects the marker against wear, abrasion, or other damage resulting from loads applied to the accessories.

Stated more specifically, in a first aspect, the present invention comprises a workpiece, a foundation, and a connector. Two bores are formed in the base of the workpiece in predetermined spaced-apart relation with each other. The connector includes a pair of upstanding interconnected rods that are disposed in spaced-apart relation corresponding to the spaced-apart relation of the pair of bores in the workpiece. The pair of upstanding interconnected rods is partially embedded in the foundation. When the workpiece is placed on the foundation, the upstanding rods of the connector engage the bores in the base of the workpiece to maintain the workpiece in a an upright position.

In the preferred embodiment of the present invention, the upstanding rods of the connector are joined by a cross member such that the connector is essentially H-shaped. Also in the preferred embodiment, the cross-member is essentially flat so as to provide an increased surface area in a plane perpendicular to the minor axis of the base that is greater than the width of the rods when the connector is embedded in the foundation. This greater width of the cross-member enhances lateral stability of the connector and thus the lateral stability of the workpiece.

In a second aspect, the present invention comprises a mounting arrangement for mounting a mounting bracket to a workpiece. A sleeve is disposed and retained within a bore in a side wall of the workpiece by both an interference fit with the bore walls and an epoxy. A mounting member of the mounting bracket engages the sleeve to mount the mounting bracket to the workpiece. If desired, a second bore and sleeve may be provided in predetermined spaced-apart relation to the first bore and a second mounting member of the mounting bracket will engage this second sleeve to enhance the engagement between the mounting bracket and the workpiece. In the disclosed embodiment, a set screw retains each mounting member of the mounting bracket in engagement with the corresponding sleeve. If the particular marker has a finished edge, a washer then fits over the outer end portion of each sleeve and abuts the side wall of the workpiece to conceal the bore and to provide an aesthetically-pleasing finished appearance.

Other objects, features, and advantages of the present invention will become apparent upon reading the following specification, when taken in conjunction with the drawings and the appended claims.

DETAILED DESCRIPTION OF THE PREFERRED EMBODIMENT

Figure 1:
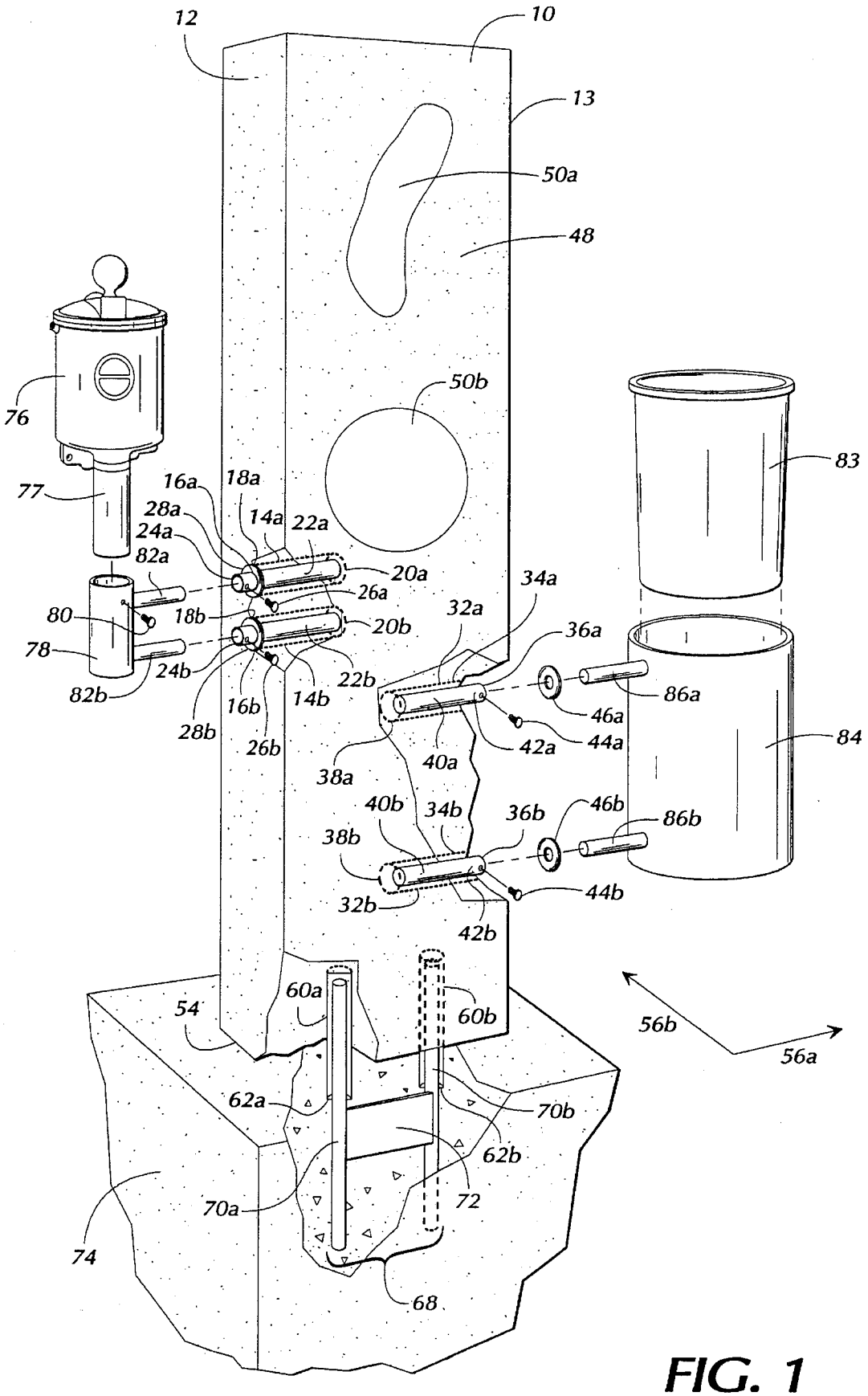
FIG. 1 is an exploded perspective view of the preferred embodiment of the present invention, partially cut away to reveal interior detail.

Referring now in detail to the drawing, the figure shows a stone golf course marker 10. The marker 10 comprises opposing lateral edges 12 and 13. The lateral edge 12 contains two bores 14*a* and 14*b* with corresponding bore openings 16*a* and 16*b*. The bore openings 16*a* and 16*b* are circumscribed by rims 18*a* and 18*b*. The bores 14*a* and 14*b* include bases 20*a* and 20*b*. The bores 14*a* and 14*b* are in a predetermined spaced-apart relation from one another and are typically six inches in depth. Sleeves 22*a*, 22*b* are composed of a non-corrosive material such as stainless steel or aluminum and are approximately five inches in length. The sleeves 22*a*, 22*b* have an outer circumference corresponding to the inner diameter of the bores 14*a*, 14*b*. Sleeves 22*a* and 22*b* are received snugly within the bores 14*a*, 14*b*. The sleeves 22*a* and 22*b* have outer end portions 24*a* and 24*b*. Set screws 26*a* and 26*b* are threaded through the outer end sleeve portions 24*a* and 24*b* and advance radially inwardly. Washers 28*a* and 28*b* have central openings dimensioned to clear the outer end sleeve portions 24*a* and 24*b* and are utilized if edge 12 is smoothly finished.

Similarly, the opposing lateral edge 13 contains two bores 32*a* and 32*b* with corresponding bore openings 34*a* and 34*b*. The bore openings 34*a* and 34*b* are circumscribed by rims 36*a* and 36*b*. The bores 32*a* and 32*b* include bases 38*a* and 38*b*. The bores 32*a* and 32*b* are in a predetermined spaced-apart relation from one another and are typically six inches in depth. The bores 32*a* and 32*b* accept sleeves 40*a* and 40*b*. Sleeves 40*a* and 40*b* are composed of a non-corrosive material, are approximately five inches in length, and have an outer circumference corresponding to the inner diameter of the bores 32*a*, 32*b*. Sleeves 40*a* and 40*b* are received snugly within bores 32*a*, 32*b*. The sleeves 40*a* and 40*b* have outer end portions 42*a* and 42*b*. Set screws 44*a* and 44*b* are threaded through the outer end sleeve portions 42*a* and 42*b* and advance radially inwardly. Washers 46*a* and 46*b* have central openings dimensioned to clear outer end sleeve portions 42*a* and 42*b* and are utilized if edge 13 is smoothly finished.

The golf course marker 10 further comprises a front face 48, an opposing back face (not shown), and a base 54. Graphics 50 and 50 are imprinted on the front face 48 and include, for example, the layout of a hole, hole yardage, hole handicap, and other assorted information. The base 54 has a major axis of elongation 56*a* and a minor axis of elongation 56*b*. Bores 60*a* and 60*b* are located in the base 54, are typically eight inches in depth and are disposed in predetermined spaced-apart location from one another.

The preferred embodiment further comprises a connector 68 having a pair of a pair of spaced-apart parallel rods 70*a* and 70*b* connected by a cross-member 72. The rods 70*a*, 70*b* are approximately twenty inches in length, approximately one inch in diameter, and are spaced apart approximately eight inches on center. The rods 70*a* and 70*b* are connected by the cross member 72 such that the connector 68 is essentially H-shaped. The cross member 72 is approximately one-quarter of an inch thick and approximately four inches high. The function and purpose of the connector 68 will become apparent when the assembly of the stone golf course marker 10 is explained below.

The disclosed embodiment further comprises a concrete foundation 74 of conventional construction well-known to those skilled in the art.

The disclosed embodiment further comprises a golf ball washer 76 of the type well-known to those skilled in the art. The golf ball washer 76 includes a vertical support member 77, the lower end of which is received within a mounting bracket 78. A set screw 80 is threaded through a wall of the mounting bracket 78 and can be advanced to tighten the vertical support member 77 within the mounting bracket 78. The mounting bracket 78 has mounting members 82*a* and 82*b* for use in connecting the mounting bracket 78 to the stone golf course marker 10. The disclosed embodiment similarly shows a trash can 83 of the type well-known to those skilled in the art. The trash can 83 fits within a cylindrical retainer 84 that includes mounting members 86*a* and 86*b* for connecting the retainer 84 to the stone golf course marker 10 in the same manner as that used for the golf ball washer 76.

Assembly and installation of the stone marker 10 will now be explained with reference to the figure. Initially, after suitable excavation for the foundation 74 has been performed, a concrete foundation 74 is poured. While the concrete is still wet, the connector 68 is partially buried in the foundation 74 so that the cross-member 72 and portions of the parallel rods 70*a* and 70*b* are embedded in the foundation 74. The upper portions of the parallel rods 70*a* and 70*b* project approximately eight inches upwardly from the foundation 74. When the concrete cures, the connector 68 is solidly anchored within the foundation 74.

After the foundation 74 cures, the stone golf course marker 10 is positioned over the outer end portions of the upwardly-extending rods 70*a* and 70*b*. The marker is lowered onto the foundation, the rods 70*a* and 70*b* being received within the bores 60*a* and 60*b* in the base 54 of the marker 10 to secure the marker to the foundation 74.

Assembly and installation of a golf ball washer 76 to a stone marker 10 will now be explained. The sleeves 22*a* and 22*b* are first inserted into the bores 14*a* and 14*b*. The sleeves 22*a* and 22*b* tightly engage the bores 14*a* and 14*b* in an interference fit so that the sleeves 22*a* and 22*b* are secured within the bores 14*a* and 14*b*. An epoxy is also injected to further engage the sleeves 22*a* and 22*b* within the bores 14*a* and 14*b*. The epoxy serves the further purpose of sealing between the sleeve and the bore wall to prevent seepage of water between the sleeve and bore wall. When the sleeves 22*a* and 22*b* have been driven into the bores 14*a* and 14*b*, outer end portions 24*a* and 24*b* of the sleeves extend outwardly approximately one inch from the lateral edge 12 of the stone marker 10. Washers 28*a* and 28*b* are inserted over the outer end portions 24*a* and 24*b* of the sleeves and are advanced over the sleeves until they abut the lateral edge 12 of the stone marker 10. In this manner the washers 28*a*, 28*b* conceal the bore openings 16*a* and 16*b* and provide an aesthetically pleasing appearance.

The mounting bracket 78 of the ball washer 76 is then affixed to the stone marker 10. The mounting members 82*a* and 82*b* are slidably engaged within the sleeves 22*a*, 22*b*. The set screws 26*a* and 26*b* are then turned to advance the tips of the set screws radially inwardly and into contact with the mounting members 82*a* and 82*b*, clamping the mounting bracket 78 securely to the stone marker 10. The ball washer 76 is then placed in the mounting bracket 78 and secured thereto by the set screw 80. The trash can 83 is then mounted to the opposing lateral edge 13 of the stone marker 10 in essentially the same manner.

In use, the connector 68 provides support and stability to the stone marker 10 in response to loads exerted against the marker. When force is applied in the general direction of the major axis of elongation 56*a*, the connector 68 provides stability to the marker 10. Furthermore, in the direction of the major axis of elongation 56*a*, the base 54 is relatively long and hence presents more resistance to tipping. Thus, loads in the direction of the major axis of elongation 56*a* present little problem.

However, in response to forces applied against the stone marker 10 in the direction of the minor axis of elongation 56*b*, the connector 68 is much more important in resisting these loads. In this direction the front and rear faces of the marker 10 present a wide profile, and hence the force exerted by a load impinging on the front and rear faces is considerably higher than the force exerted by a load applied against the lateral edges. The base 54 in the direction of the minor axis of elongation 56*b* is narrow, providing much less resistance to tipping. In this situation the engagement between the upstanding rods 70*a* and 70*b* and the bores 60*a* and 60*b* in the base of the marker 10 is of critical importance in maintaining the marker in its upright position.

Normal use of the accessories such as the disclosed ball washer 76 and trash can 83, or a towel holder, water container, spike cleaner, or other accessory mounted to the marker 10, can result in lateral loads which are transmitted to the marker. The mounting members 82*a*, 82*b*, 86*a*, and 86*b* which engage the marker 10 tend to exert forces at the rims and bases of their respective bores 14*a*, 14*b*, 32*a*, or 32*b*. However, since the bores 14*a*, 14*b*, 32*a*, and 32*b* are all fitted with sleeves 22*a*, 22*b*, 40*a*, and 40*b* respectively, the forces exerted by the mounting members are dispersed along the length of the bores, rather than concentrated at the rims and bases of the bores. By dispersing the forces in this manner, the likelihood of the marker 10 becoming chipped, cracked, or otherwise damaged through normal use of the accessories is drastically reduced.

One feature of the disclosed embodiment is that the rods 70*a* and 70*b* are held together in a pre-determined spaced-apart relation by the cross member 72. This feature allows even unskilled labor to correctly install a connector 68 in a concrete foundation 74 because the predetermined spaced-apart relation between the rods 70*a* and 70*b* is provided by the cross member 72. Because the rods 70*a* and 70*b* are always disposed in the desired spaced-apart relation, the bores 60*a* and 60*b* may be "pre-drilled" in the base 54 of the stone marker 10 at the manufacturing facility by skilled labor and with the proper tools. A further advantage of the cross-member 72 is that it provides added surface area to the portion of the connector 68 embedded in the foundation 74. This added surface area enhances the stability along the minor axis 56*b* of the base 54. Even after the concrete foundation goes through several thermal cycles or the concrete otherwise weakens or cracks, the rods 70*a* and 70*b* will have less of a tendency to pull loose from the foundation 74.

Another feature of the present embodiment includes the sleeves 22*a* and 22*b* that engage the bores 14*a* and 14*b* in an interference fit. The advantage that this feature provides is that when the mounting members 82*a* and 82*b* exert force against the sleeves 22*a* and 22*b*, the sleeves spread the force over the entire surface area of the bores 14*a* and 14*b*. Because the force is spread over a large surface area and is not isolated at the rims 18*a* and 18*b* and the bases 20*a* and 20*b* of the bores, cracking, chipping and other possible damage to the stone in and around the bores is minimized.

Another advantage produced by the sleeves 22*a* and 22*b* is that the mounting members 82*a* and 82*b* can be easily disengaged. The mounting members 82*a* and 82*b* are not attached to the bores 14*a* and 14*b* by a permanent substance such as an epoxy or caulk. If a golf ball washer 76 is in need of repair, the set screws 26*a* and 26*b* can be loosened and the mounting bracket 78 and the golf ball washer 76 can be easily removed.

While the preferred embodiment has been disclosed with respect to a connector 68 for a stone golf course marker 10, it should be understood that the mounting arrangement can also be used to support other workpieces, such as historical landmark signs and cemetery headstones.

It should be further appreciated that while the sleeves 22*a* and 22*b* are held in position by an interference fit with the bores 14*a* and 14*b*, other methods can be employed to secure the sleeves 22*a* and 22*b* in the bores 14*a* and 14*b*, such as adhesives or set screws.

It should also be appreciated that while the golf ball washer 76 is fastened within a mounting bracket 78 by a set screw 80, other methods can be employed to fasten the golf ball washer within the mounting bracket, such as a welded connection or an adhesive substance.

While the preferred embodiment has been disclosed with respect to an arrangement for mounting a golf ball washer and a trash can to a stone golf course marker, it will be appreciated that similar mounting arrangements may be employed to mount other types of accessory equipment to a stone golf course marker. In a broader sense, the disclosed mounting arrangement can be used to mount a variety of mounting brackets to a workpiece.

Figure 2:
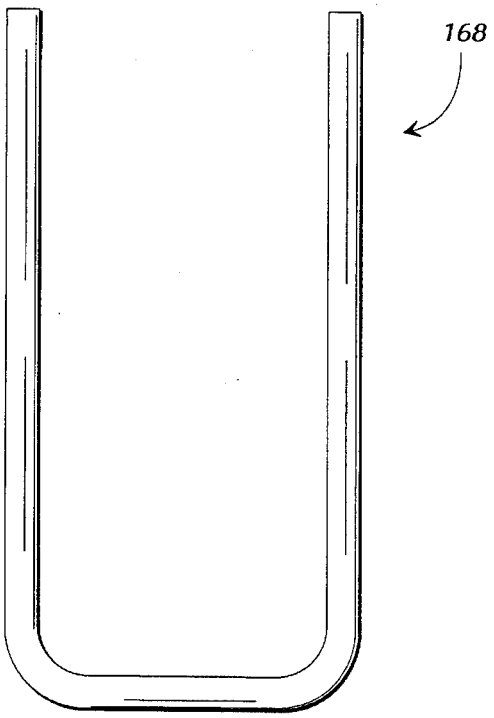
FIG. 2 is a front elevational view of a first alternate embodiment of the present invention.
Figure 3:
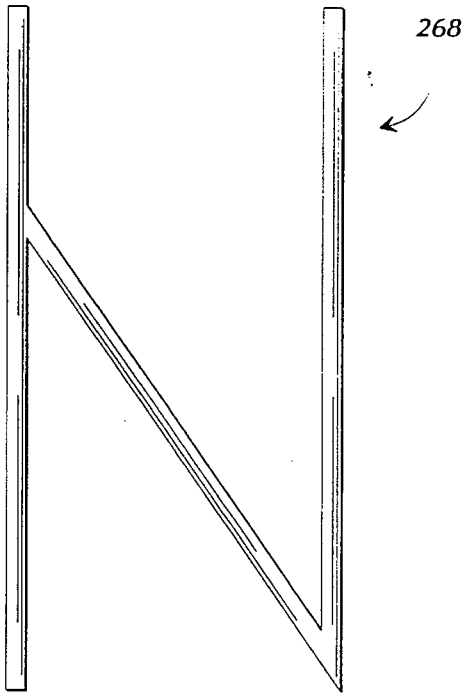
FIG. 3 is a front elevational view of a second alternate embodiment of the present invention.
Figure 4:
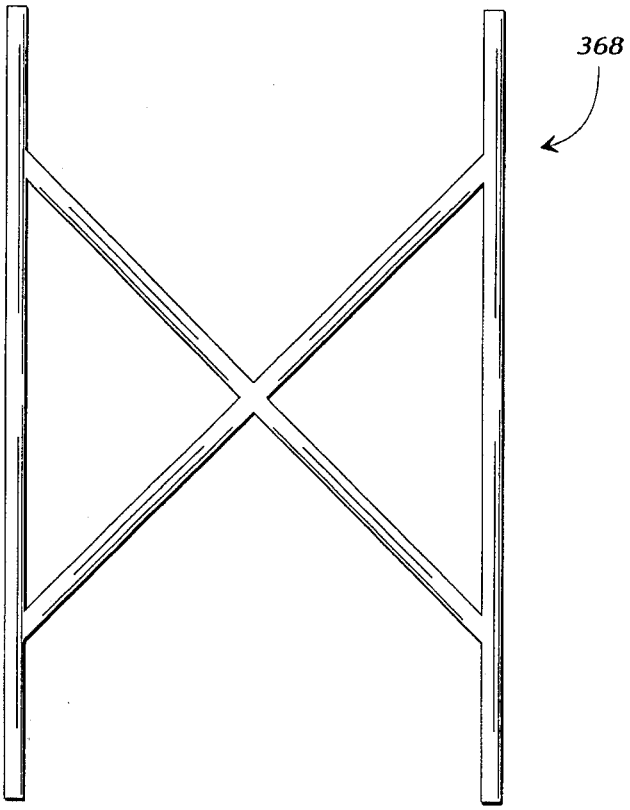
FIG. 4 is a front elevational view of a third alternate embodiment of the present invention.

While the connector 68 of the disclosed embodiment is essentially H-shaped, it will be appreciated that other configurations will provide the desired function of monitoring the rods in parallel spaced-apart relation. Other examples of suitable connector configurations would include a U-shaped connector, shown at 168 in FIG. 2 an N-shaped connector, shown at 268 in FIG. 3 or a connector comprising parallel spaced-apart rods interconnected by an X-shaped cross member, shown at 368 in FIG. 4.

Finally, it will be understood that the preferred embodiment has been disclosed by way of example, and that other modifications may occur to those skilled in the art without departing from the scope and spirit of the appended claims.

What is claimed is:

1. An apparatus comprising:

a concrete foundation;

a connector having a pair of upstanding rods disposed in predetermined spaced apart relation and joined by a cross member, said connector having a portion thereof including at least a portion of said cross member embedded within said concrete foundation, and said rods and cross member of said connector forming a shape selected from among the following shapes: H-shaped, U-shaped, N-shaped, and X-shaped; and a workpiece having a base resting on said concrete foundation, said base having a pair of bores formed in said predetermined spaced apart relation such that said upstanding rods of said connector engage said bores to maintain said workpiece in an upright position on said concrete foundation.

2. The apparatus of claim 1, wherein the width of said cross-member in a vertical plane intersecting said upstanding rods is larger than the width of said rods in said vertical plane so as to enhance lateral stability of said connector.

3. The apparatus of claim 1, wherein said workpiece comprises golf course signage.

4. An apparatus comprising:

a foundation resting upon a section of ground;

a connector having a pair of upstanding rods disposed in predetermined spaced apart relation and joined by a cross member, said connector having a portion thereof including at least a portion of said cross member embedded within said foundation, and said rods and cross member of said connector forming a shape selected from among the following shapes: H-shaped, U-shaped, N-shaped, and X-shaped; and a workpiece having a base resting on said foundation, said base having a pair of bores formed in said predetermined spaced apart relation such that said upstanding rods of said connector engage said bores to maintain said workpiece in an upright position on said foundation.

5. The apparatus of claim 4, wherein the width of said cross-member in a vertical plane intersecting said upstanding rods is larger than the width of said rods in said vertical plane so as to enhance lateral stability of said connector.

* * * * *